US011970670B2

(12) United States Patent
Hartikainen et al.

(10) Patent No.: US 11,970,670 B2
(45) Date of Patent: Apr. 30, 2024

(54) PENETRATING OIL AND METHOD FOR PRODUCING THE SAME

(71) Applicant: Neste Oyj, Espoo (FI)

(72) Inventors: Jukka Hartikainen, Porvoo (FI); Jouni Karttunen, Porvoo (FI); Virpi Rämö, Porvoo (FI); Jorma Virtanen, Porvoo (FI)

(73) Assignee: NESTE OYJ, Espoo (FI)

( * ) Notice: Subject to any disclaimer, the term of this patent is extended or adjusted under 35 U.S.C. 154(b) by 226 days.

(21) Appl. No.: 17/618,623

(22) PCT Filed: Nov. 18, 2019

(86) PCT No.: PCT/FI2019/050823
§ 371 (c)(1),
(2) Date: Dec. 13, 2021

(87) PCT Pub. No.: WO2020/249846
PCT Pub. Date: Dec. 17, 2020

(65) Prior Publication Data

US 2022/0298446 A1 Sep. 22, 2022

(30) Foreign Application Priority Data

Jun. 14, 2019 (FI) ..... 20195523

(51) Int. Cl.
*C10M 169/04* (2006.01)
*C10M 111/02* (2006.01)
*C10N 30/00* (2006.01)

(52) U.S. Cl.
CPC ..... *C10M 169/04* (2013.01); *C10M 111/02* (2013.01); *C10M 2201/041* (2013.01);
(Continued)

(58) Field of Classification Search
CPC ..... C10M 169/04; C10M 111/02; C10M 2201/041; C10M 2201/061;
(Continued)

(56) References Cited

U.S. PATENT DOCUMENTS 2,491,774 A 12/1949 Schulz
3,578,596 A 5/1971 Conway
(Continued)

FOREIGN PATENT DOCUMENTS

CN 101193841 A 6/2008
CN 101218331 A 7/2008
(Continued)

OTHER PUBLICATIONS

Office Action dated May 11, 2022, by the Chinese Patent Office in corresponding Chinese Patent Application No. 201980096833.3. (8 pages).
(Continued)

*Primary Examiner* — Taiwo Oladapo
(74) *Attorney, Agent, or Firm* — BUCHANAN INGERSOLL & ROONEY PC

(57) ABSTRACT

A penetrating oil including isoalkane solvent and oil derived from biological sources and a method for producing the same, are disclosed. Use of a composition containing isoalkane solvent and oil derived from biological sources is further disclosed.

21 Claims, 2 Drawing Sheets

(52) U.S. Cl.
CPC . *C10M 2201/061* (2013.01); *C10M 2201/066* (2013.01); *C10M 2201/16* (2013.01); *C10M 2203/0206* (2013.01); *C10M 2207/401* (2013.01); *C10M 2213/062* (2013.01); *C10N 2030/26* (2020.05); *C10N 2030/64* (2020.05)

(58) Field of Classification Search
CPC ..... C10M 2201/066; C10M 2201/16; C10M 2203/0206; C10M 2207/401; C10M 2213/062; C10M 2201/00; C10M 2201/04; C10M 2203/02; C10M 2207/40; C10N 2030/26; C10N 2030/64; C10N 2020/02; C10N 2020/06; C10N 2030/00; C10N 2030/04; C10N 2040/00
See application file for complete search history.

(56) References Cited

U.S. PATENT DOCUMENTS

| | | | |
|---|---|---|---|
| 3,917,537 | A | 11/1975 | Elsdon |
| 4,198,313 | A | 4/1980 | Bargigia et al. |
| 8,821,842 | B2 | 9/2014 | Lange et al. |
| 2003/0040444 | A1 | 2/2003 | Garmier |
| 2003/0069146 | A1 | 4/2003 | Garmier |
| 2008/0193404 | A1 | 8/2008 | Lange et al. |
| 2010/0105583 | A1 | 4/2010 | Garmier |
| 2013/0053286 | A1 | 2/2013 | Westerman et al. |
| 2018/0155636 | A1 | 6/2018 | Germanaud et al. |
| 2020/0318018 | A1 | 10/2020 | Germanaud et al. |

FOREIGN PATENT DOCUMENTS

| | | | | | |
|---|---|---|---|---|---|
| CN | 101331214 | A | | 12/2008 | |
| CN | 101993762 | A | * | 3/2011 | |
| CN | 107667161 | A | | 2/2018 | |
| CN | 107858191 | A | | 3/2018 | |
| JP | H02127497 | A | | 5/1990 | |
| JP | 2008539316 | A | | 11/2008 | |
| JP | 2009215483 | A | | 9/2009 | |
| PL | 137551 | B1 | | 6/1986 | |
| PL | 197464 | B1 | | 4/2008 | |
| WO | WO-2006120003 | A1 | * | 11/2006 | ..... A61K 8/0212 |

OTHER PUBLICATIONS

Finnish Communication of Acceptance under section 29a of Patents Decree dated Dec. 9, 2019 issued by the Finnish Patent and Registration Office in corresponding Finnish Patent Application No. 20195523. (2 pages).

Finnish Office Action and Search Report dated Oct. 11, 2019 issued by the Finnish Patent and Registration Office in corresponding Finnish Patent Application No. 20195523. (7 pages).

International Search Report (PCT/ISA/210) and Written Opinion (PCT/ISA/237) dated Mar. 13, 2020, by the European Patent Office as the International Searching Authority for International Application No. PCT/FI2019/050823. (12 pages).

Office Action (Notice of Reasons for Refusal) dated Dec. 13, 2022, by the Japanese Patent Office in corresponding Japanese Patent Application No. 2021-573541, and an English Translation of the Office Action. (8 pages).

* cited by examiner

PENETRATING OIL AND METHOD FOR PRODUCING THE SAME

TECHNICAL FIELD

The present invention generally relates to penetrating and release oils. The invention relates particularly, though not exclusively, to a composition comprising an isoalkane solvent and oil derived from biological sources, and use of said composition.

BACKGROUND ART

This section illustrates useful background information without admission of any technique described herein representative of the state of the art.

Penetrating and release oils are generally based on oils of fossil origin. Penetrating and release oils are able to penetrate between surfaces that are in close contact with each other, such as threaded metal parts, hinges, locks, or pipe fittings, and to loosen surfaces that have become stuck together for example due to rusting. Conventional penetrating and release oils are often rather volatile, which may for example cause health concerns and impair the lubricating properties of the penetrating and release oils. Because penetrating and release oils are generally applied directly on the surfaces in close contact or the surfaces being stuck together, it is very likely that at least a portion of the applied oil will end up in the environment, typically by evaporation and/or dripping. Conventional penetrating and release oils are generally not biodegradable and therefore their use usually pose environmental concerns.

There thus exists a need to provide safer and more environmentally friendly penetrating and release oil compositions.

SUMMARY

According to a first aspect of the invention there is provided a penetrating oil comprising: 55-98 vol-% isoalkane solvent of the total volume of the penetrating oil; and 2-30 vol-% oil derived from biological sources of the total volume of the penetrating oil. Surprisingly, the penetrating oil of the first aspect has very good penetrating performance, release and rust removal properties, as well as satisfactory lubricating properties.

In certain embodiments, the penetrating oil comprises a lubricity additive 0.1-5 vol-% of the total volume of the penetrating oil, the lubricity additive comprising 5-50 wt-% solid particles and 50-95 wt-% carrier oil of the total weight of the lubricity additive. The lubricity additive further improves the release properties, the separation properties (separation of surface in close contact with each other), and lubricating properties of the penetrating oil, particularly at high pressure conditions (when a high load is directed to the penetrating oil).

In certain embodiments, the penetrating oil comprises 2-20 vol-%, preferably 5-10 vol-% oil derived from biological sources of the total volume of the penetrating oil. The stability and storage properties (length of shelf life) of the penetrating oil improve as the vol-% amount of the oil derived from biological sources in the penetrating oil decreases. Nevertheless, a certain amount of oil derived from biological sources in the penetrating oil is preferred in order to obtain a desirable viscosity profile and good lubricating and release properties of the penetrating oil. In certain embodiments, the oil derived from biological sources is an ester oil, preferably a triglyceride oil. In certain embodiments, the oil derived from biological sources is vegetable oil or optionally a derivative thereof, preferably rapeseed oil or optionally a derivative thereof.

In certain embodiments, the penetrating oil comprises 70-95 vol-%, preferably 80-94 vol-%, more preferably 85-92 vol-% isoalkane solvent of the total volume of the penetrating oil. Increasing the vol-% amount of the isoalkane solvent in the penetrating oil further improves the penetrating performance, the release properties, and the rust removal properties of the penetrating oil.In certain embodiments, the isoalkane solvent comprises at least 85 wt-%, preferably at least 90 wt-%, more preferably at least 93 wt-% isoalkanes of the total weight of the isoalkane solvent. Surprisingly, a high wt-% of isoalkanes in the isoalkane solvent improves the performance (penetrating performance, release properties, rust removal properties) of the penetrating oil particularly at low ambient temperatures (such as −10° C. and colder temperatures). In certain embodiments, the isoalkane solvent comprises at most 98 wt-% isoalkanes of the total weight of the isoalkane solvent.

In certain embodiments, of the isoalkanes in the isoalkane solvent at least 70 wt-%, preferably at least 80 wt-%, more preferably at least 85 wt-%, even more preferably at least 90 wt-% are in the range of carbon number C14-C20, preferably in the range of carbon number C14-C18, more preferably in the range of carbon number C16-C18. A high wt-% amount of isoalkanes in the range of carbon number C14-C20 provides the penetrating oil with a prolonged release and lubricating effect. A high wt-% amount of isoalkanes in the range of carbon number C14-C20 also contributes to providing the penetrating oil with beneficial kinematic viscosity. Further, a high wt-% amount of isoalkanes in the range of carbon number C14-C20 provides the penetrating oil with a beneficial evaporation profile, i.e. such penetrating oils evaporates slowly. These effects are further pronounced when the isoalkane solvent comprises a high wt-% amount of isoalkanes is in the range of carbon number C14-C18, particularly C16-C18. In certain embodiments, the penetrating oil comprises volatile organic compounds (VOCs) less than 5 wt-% of the total weight of the penetrating oil. A low wt-% amount of VOCs in the penetrating oil improves user safety. In certain embodiments, of the isoalkanes in the isoalkane solvent at most 95 wt-% are in the range of carbon number C14-C20.

In certain embodiments, the isoalkane solvent has a kinematic viscosity below 12 $mm^2/s$, preferably below 10 $mm^2/s$, more preferably below 8.0 $mm^2/s$ at 20° C. as measured according to ENISO3104/1996. An isoalkane solvent having low kinematic viscosity provides the penetrating oil with good penetrating performance. The penetrating performance of the penetrating oil improves as the kinematic viscosity of the isoalkane solvent decreases. To balance good penetrating performance with good release properties of the penetrating oil, it is preferred that the isoalkane solvent has a kinematic viscosity of at least 1.0 $mm^2/s$, preferably at least 2.0 $mm^2/s$, more preferably at least 3.0 mm2/s at 20° C. as measured according to ENISO3104/1996. In certain embodiments, the isoalkane solvent has a kinematic viscosity below 8.0 $mm^2/s$, preferably below 7.0 $mm^2/s$, more preferably below 6.0 $mm^2/s$ at 40° C. as measured according to ENISO3104/1996, and a kinematic viscosity of at least 1.0 mm2/s, preferably at least 1.5 $mm^2/s$, more preferably at least 2.0 $mm^2/s$ at 40° C. as measured according to ENISO3104/1996.

In certain embodiments, the isoalkane solvent has a pour point below −30° C., preferably below −40° C., more preferably below −50° C., even more preferably below −60° C. as measured according to ASTM D 5950-2014. A low pour point of the isoalkane solvent provides the penetrating oil with good cold properties allowing it to be used as a penetrating oil at low ambient temperatures, such as at −10° C. and colder temperatures, for example at −20° C. and colder temperatures, or at −30° C. and colder temperatures. A low pour point of the isoalkane solvent contributes to a beneficial viscosity profile of the penetrating oil, namely a less pronounced increase in kinematic viscosity as the ambient temperature decreases.

In certain embodiments, the isoalkane solvent has a flash point above 60° C., preferably above 65° C., more preferably above 70° C. as measured according to ASTM D 93-2010a (2011). An isoalkane solvent with a high flash point improves the safety of the penetrating oil, both during use and storage of the penetrating oil. The flash point of the isoalkane solvent may be as high as 80° C. or more, or even 100° C. or more, which may be desired in certain applications.

In certain embodiments, the penetrating oil comprises 0.5-2 vol-%, preferably 0.9-2 vol-% lubricity additive of the total volume of the penetrating oil. It was found that already a relatively small vol-% amount of the lubricity additive provides the penetrating oil with the further improved release, separation, and lubricating properties.

In certain embodiments, the penetrating oil comprises a lubricity additive comprising, based on the total weight of the lubricity additive, 5-50 wt-% solid particles and 50-95 wt-% carrier oil, preferably 10-40 wt-% solid particles and 60-90 wt-% carrier oil, further preferably 10-30 wt-% solid particles and 70-90 wt-% carrier oil, and even more preferably 20-30 wt-% solid particles and 70-80 wt-% carrier oil. Such wt-% amounts of solid particles and carrier oil in the lubricity additive were found to provide the penetrating oil with particularly good release, separation, and lubricating properties.

In certain embodiments, the solid particles of the lubricity additive have a particle size below 50 μm, preferably below 20 μm, more preferably below 10 μm, and even more preferably below 1 μm. Solid particles with a particle size below said values were found to penetrate particularly well between surfaces in close contact with each other. In certain embodiments, the solid particles of the lubricity additive have a particle size above 10 nm, preferably above 30 nm, more preferably above 50 nm, even more preferably above 70 nm. Solid particles with a particle size above said values were found to provide the penetrating oil with good lubricating properties and particularly good separation properties, especially when a high load is directed at the penetrating oil.

In certain embodiments, the solid particles of the lubricity additive are selected from boron nitride particles, graphite particles, molybdenum sulfide particles, or polytetrafluoroethylene particles, or optionally a combination thereof. Said particle materials provide the penetrating oil with particularly good lubricating and separating properties.

The penetrating oil may be provided as an aerosol to facilitate the use (application) of the penetrating oil. In certain embodiments, the penetrating oil comprises a propellant 1-10 vol-% of the total volume of the penetrating oil.

In certain embodiments, the propellant is selected from propane, butane, $CO_2$, $N_2$, or air, or optionally a combination thereof, preferably from air, $CO_2$, or $N_2$, or optionally a combination thereof. The penetrating oil may be successfully formulated with various propellants. Air, $CO_2$, or $N_2$, or a combination thereof, are preferred because said propellants are non-flammable, inert, and do not pose environmental concerns. In certain embodiments, the penetrating oil comprises 2-7 vol-% $CO_2$ as propellant of the total volume of the penetrating oil. 2-7 vol-% $CO_2$ as propellant was found to form with the other components of the penetrating oil an aerosol with a particularly beneficial droplet size well suited for use as penetrating oil.

According to a second aspect of the invention there is provided a method for producing a penetrating oil comprising the steps of: mixing an isoalkane solvent with an oil derived from biological sources to form a penetrating oil comprising 55-98 vol-% isoalkane solvent and 2-30 vol-% oil derived from biological sources of the total volume of the penetrating oil.

In certain embodiments, the method comprises mixing solid particles with a carrier oil to form a lubricity additive comprising 5-50 wt-% solid particles and 50-95 wt-% carrier oil of the total weight of the lubricity additive; and mixing the lubricity additive with the isoalkane solvent and the oil derived from biological sources to form a penetrating oil comprising 55-97.9 vol-% isoalkane solvent, 0.1-5 vol-% lubricity additive, and 2-30 vol-% oil derived from biological sources of the total volume of the penetrating oil.

In certain embodiments, the mixing of solid particles with the carrier oil is performed by high speed mixing at 1000-10000 rpm. High speed mixing at 1000-10000 rpm was found to promote the dispersion of solid particles in the carrier oil and to improve the stability of the lubricity addictive (prolong the time before solid particles start to sediment in the lubricity additive). In certain embodiments, the duration of the high speed mixing is 0.5-4 h, and the high speed mixing is performed at a temperature selected from the range from 15 to 35° C. Such high speed mixing was found to particularly promote the dispersion of solid particles in the carrier oil and to further improve the stability of the lubricity additive.

In certain embodiments, the method comprises mixing the isoalkane solvent, the oil derived from biological sources, and optionally the lubricity additive, with a propellant to form a penetrating oil comprising 55-97 vol-% isoalkane solvent, 2-30 vol-% oil derived from biological sources, 1-10 vol-% propellant, and optionally 0.1-5 vol-% lubricity additive, of the total volume of the penetrating oil.

According to a third aspect of the invention there is provided use of a composition comprising 55-98 vol-% isoalkane solvent and 2-30 vol-% oil derived from biological sources as a penetrating oil, release oil and/or a rust remover.

According to a fourth aspect of the invention there is provided a method for using a composition comprising 55-98 vol-% isoalkane solvent and 2-30 vol-% oil derived from biological sources as a penetrating oil, release oil and/or a rust remover.

In certain embodiments, the composition comprises a lubricity additive 0.1-5 vol-% of the total volume of the composition, the lubricity additive comprising 5-50 wt-% solid particles and 50-95 wt-% carrier oil of the total weight of the lubricity additive.

In certain embodiments, the composition comprises 2-20 vol-%, preferably 5-10 vol-% oil derived from biological sources of the total volume of the composition. In certain embodiments, the composition comprises 70-95 vol-%, preferably 80-94 vol-%, more preferably 85-92 vol-% isoalkane solvent of the total volume of the composition. In certain embodiments, the composition comprises 0.5-2 vol-%, preferably 0.9-2 vol-% lubricity additive of the total volume of the composition.

In certain embodiments, the composition comprises a propellant 1-10 vol-% of the total volume of the composition. In certain embodiments, the composition comprises 2-7 vol-% $CO_2$ as propellant of the total volume of the composition.

Different non-binding aspects and embodiments of the present invention have been illustrated in the foregoing. The embodiments in the foregoing are used merely to explain selected aspects or steps that may be utilized in implementations of the present invention. Some embodiments may be presented only with reference to certain aspects of the invention. It should be appreciated that corresponding embodiments may apply to other aspects as well.

BRIEF DESCRIPTION OF THE DRAWINGS

Some example embodiments will be described with reference to the accompanying drawings, in which.

DETAILED DESCRIPTION

Figure 1:
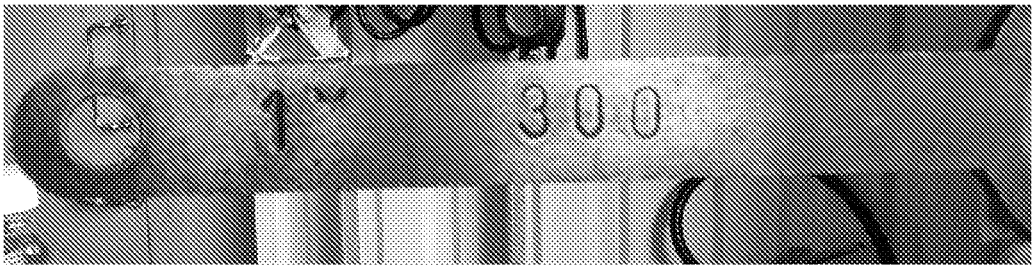
FIG. 1 shows a picture of a metal tool after rust removal treatment by rubbing.

As used herein, penetrating oil and release oil are used substantially as synonyms.

It is generally known that isoalkane(s) and isoparaffin(s) are synonyms and can be used interchangeably.

As used herein, biological sources refer to plants and animals, and materials and products derivable therefrom, including fungi and algae and materials and products derivable therefrom. Biological sources may also be referred to as renewable sources.

As used herein, fossil sources or mineral sources refer to naturally occurring non-renewable sources, such as crude oil, petroleum oil/gas, shale oil/gas, natural gas, or coal deposits, and the like, and combinations thereof, including any hydrocarbon-rich deposits that can be utilized from ground/underground sources. The term fossil or mineral may also refer to recycling material originating from non-renewable sources.

Carbon atoms of renewable or biological origin comprise a higher number of $^{14}C$ isotopes compared to carbon atoms of fossil origin. Therefore, it is possible to distinguish between carbon compounds derived from renewable or biological sources or raw material and carbon compounds derived from fossil sources or raw material by analysing the ratio of $^{12}C$ and $^{14}C$ isotopes. Thus, a particular ratio of said isotopes can be used as a "tag" to identify a renewable carbon compound and differentiate it from non-renewable carbon compounds. The isotope ratio does not change in the course of chemical reactions. An example of a suitable method for analysing the content of carbon from biological or renewable sources is DIN 51637 (2014).

The present invention provides a penetrating oil comprising 55-98 vol-% isoalkane solvent of the total volume of the penetrating oil, and 2-30 vol-% oil derived from biological sources of the total volume of the penetrating oil. It has surprisingly been found that a penetrating oil comprising a high vol-% amount isoalkane solvent and of an oil derived from biological sources has very good penetrating performance, release properties, and rust removal properties. Further, such penetrating oil compositions have satisfying lubricating properties and a relatively low water uptake which allows them to function as a water barrier.

Surprisingly, increasing the vol-% amount of the isoalkane solvent in the penetrating oil further improves the penetrating performance and rust removal properties of the penetrating oil. Further, increasing the vol-% amount of the isoalkane solvent in the penetrating oil improves the stability and cold properties of the penetrating oil, particularly compared to penetrating oils comprising a significant amount, such as over 30 vol-% or over 40 vol-%, of triglyceride oils and/or fatty acid alkyl esters, such as fatty acid methyl esters. Improved or good cold properties refers herein to satisfactory penetrating performance, release properties, and lubricating properties at low ambient temperatures, such as −10° C. or colder, for example −20° C. or colder, or −30° C. or colder. In certain embodiments, the penetrating oil comprises, based on the total volume of the penetrating oil, 70-98 vol-% isoalkane solvent and 2-30 vol-% oil derived from biological sources, preferably 80-98 vol-% isoalkane solvent and 2-20 vol-% oil derived from biological sources.

The volume ratio of the isoalkane solvent and the oil derived from biological sources may be easily adjusted so as to provide optimal solvent power and surface tension characteristics to the penetrating oil for each material to be treated. The solvent power and surface tension are contributed by the non-polar character of the isoalkane solvent and the polar character of the oil derived from biological sources.

In certain embodiments, the total amount of the isoalkane solvent and the oil derived from biological sources in the penetrating oil is at least 95 vol-%, preferably at least 98 vol-%, further preferably at least 99 vol-% of the total volume of the penetrating oil.

Both the isoalkane solvent and the oil derived from biological sources are biodegradable, which makes the penetrating oil less harmful to the environment compared to conventional penetrating oils comprising mainly non-biodegradable components. The isoalkane solvent may optionally be derived from renewable or biological sources, which increases the amount of renewable compounds in the penetrating oil. Accordingly, in certain embodiments, the isoalkane solvent is a renewable isoalkane solvent (isoalkane solvent derived from renewable or biological sources). In such embodiments, the penetrating oil may optionally substantially consist of renewable and biodegradable components.

In certain embodiments, the penetrating oil comprises, based on the total volume of the penetrating oil, 55-97.9 vol-% isoalkane solvent, 2-30 vol-% oil derived from biological sources, and 0.1-5 vol-% lubricity additive comprising 5-50 wt-% solid particles and 50-95 wt-% carrier oil of the total weight of the lubricity additive. The lubricity additive comprising solid particles improves the separation and release properties and the lubricating properties of the penetrating oil. Further, the lubricity additive improves the performance (release properties, separation properties, lubricating properties) of the penetrating oil at high pressure conditions (under high load).

In certain embodiments, the penetrating oil of the present invention comprises a lubricity additive comprising, based on the total weight of the lubricity additive, 10-40 wt-% solid particles and 60-90 wt-% carrier oil, preferably 10-30 wt-% solid particles and 70-90 wt-% carrier oil, and more preferably 20-30 wt-% solid particles and 70-80 wt-% carrier oil. Preferably, the total amount of the solid particles and the carrier oil in the lubricity additive is at least 98 wt-%, more preferably at least 99 wt-% of the total weight of the lubricity additive. Such wt-% amounts of solid particles and carrier oil in the lubricity additive were found to provide the penetrating oil with particularly good release, separation, and lubricating properties.

It was surprisingly found that the separation, release and lubricating properties of the release oil do not improve linearly with increasing the vol-% amount of the lubricity additive in the penetrating oil. Rather, it was found that already a relatively low vol-% amount of the lubricity additive in the penetrating oil provides very good separation, release, and lubricating properties, after which increasing the vol-% amount of the lubricity additive does no longer improve said properties. In certain preferred embodiments, the penetrating oil comprises, based on the total volume of the penetrating oil, 70-97.5 vol-% isoalkane solvent, 2-20 vol-% oil derived from biological sources, and 0.5-2 vol-% lubricity additive comprising 10-40 wt-% solid particles and 60-90 wt-% carrier oil of the total weight of the lubricity additive. In certain particularly preferred embodiments, the penetrating oil comprises, based on the total volume of the penetrating oil, 80-94.1 vol-%, preferably 85-92 vol-%, isoalkane solvent, 5-10 vol-% oil derived from biological sources, and 0.9-2 vol-% lubricity additive comprising 10-30 wt-% solid particles and 70-90 wt-% carrier oil of the total weight of the lubricity additive. The total amount of the isoalkane solvent, the oil derived from biological sources, and the lubricity additive in the penetrating oil may be at least 95 vol-%, preferably at least 98 vol-%, further preferably at least 99 vol-% of the total volume of the penetrating oil.

The penetrating oil of the present invention is very stable and has a long shelf life particularly due to its high vol-% amount of the isoalkane solvent. The penetrating oil may thus be formulated without antioxidant additives. Accordingly, in certain embodiments, the penetrating oil is a penetrating oil without antioxidant additive.

In certain embodiments, the penetrating oil is a penetrating oil without fatty acid methyl esters and/or fatty acid ethyl esters, which contributes to a high stability of the penetrating oil.

The penetrating oil of the present invention is suitable for use as a penetrating and release oil at low ambient temperatures, such as at -10° C. or colder, for example at −20° C. or colder, or at -30° C. or colder. The penetrating and release performance of the penetrating oil at low ambient temperatures is further improved as the vol-% of the isoalkane solvent in the penetrating oil increases. In certain embodiments, the penetrating oil is a penetrating oil without cold property improvers, such as pour point depressant, cold flow improver, or both.

To facilitate the use (application) of the penetrating oil, particularly in customer applications, the penetrating oil may be provided as an aerosol. It was found that the penetrating oil can be formulated with various propellants, particularly with propane, butane, $CO_2$, $N_2$, or air, or optionally a combination thereof. Because both propane and butane are flammable, the propellant is preferably $CO_2$, $N_2$, or air, or optionally a combination thereof. The preferred propellants are inert, safe, and do not pose environmental concerns. In the embodiments in which the penetrating oil is provided as an aerosol, the penetrating oil comprises 1-10 vol-% propellant of the total volume of the penetrating oil. Thus, in certain embodiments, the penetrating oil comprises, based on the total volume of the penetrating oil, 55-97 vol-% isoalkane solvent, 2-30 vol-% oil derived from biological sources, and 1-10 vol-% propellant, preferably 2-7 vol-% $CO_2$.

In certain embodiments, the penetrating oil comprises 1-10 vol-% propellant, preferably 2-7 vol-% $CO_2$, and 70-97 vol-% isoalkane solvent and 2-29 vol-% oil derived from biological sources, preferably 80-97 vol-% isoalkane solvent and 2-19 vol-% oil derived from biological sources of the total volume of the penetrating oil. The total amount of the isoalkane solvent, the oil derived from biological sources, and the propellant in the penetrating oil may be at least 98 vol-%, further preferably at least 99 vol-% of the total volume of the penetrating oil.

In certain preferred embodiments, the penetrating oil comprises, based on the total volume of the penetrating oil, 55-96.9 vol-% isoalkane solvent, 2-30 vol-% oil derived from biological sources, 0.1-5 vol-% lubricity additive comprising 5-50 wt-% solid particles and 50-95 wt-% carrier oil of the total weight of the lubricity additive, and 1-10 vol-% propellant, preferably 2-7 vol-% $CO_2$. More preferably, the penetrating oil comprises, based on the total volume of the penetrating oil, 70-96.5 vol-% isoalkane solvent, 2-20 vol-% oil derived from biological sources, 0.5-2 vol-% lubricity additive comprising 10-40 wt-% solid particles and 60-90 wt-% carrier oil of the total weight of the lubricity additive, and 1-10 vol-% propellant, preferably 2-7 vol-% $CO_2$. Even more preferably, the penetrating oil comprises, based on the total volume of the penetrating oil, 80-93.1 vol-%, preferably 85-92.1 vol-% isoalkane solvent, 5-10 vol-% oil derived from biological sources, 0.9-2 vol-% lubricity additive comprising 10-30 wt-% solid particles and 70-90 wt-% carrier oil of the total weight of the lubricity additive, and 1-10 vol-% propellant, preferably 2-7 vol-% $CO_2$. The total amount of the isoalkane solvent, the oil derived from biological sources, the lubricity additive, and the propellant in the penetrating oil is preferably at least 98 vol-%, more preferably at least 99 vol-% of the total volume of the penetrating oil.

In the embodiments wherein the penetrating oil comprises the preferred 2-7 vol-% $CO_2$ as propellant, the upper limit of the vol-% range of the isoalkane solvent is adjusted accordingly so that the sum of the vol-% of the isoalkane solvent, $CO_2$, the oil derived from biological sources, and the optional lubricity additive does not exceed 100 vol-%. As an example demonstrating said adjustment, for a penetrating oil according to the embodiments comprising 55-97 vol-% isoalkane solvent, 2-30 vol-% oil derived from biological sources, and 1-10 vol-% propellant, preferably 2-7 vol-% $CO_2$, the vol-% range of the isoalkane solvent is adjusted from 55-97 vol-% to 55-96 vol-% when the penetrating oil comprises 2-7 vol-% $CO_2$ instead of 1-10 vol-% propellant, while the vol-% range of the oil derived from biological sources is kept constant at 2-30 vol-%. This applies mutatis mutandis to the other embodiments disclosed herein.

Preferably, the isoalkane solvent comprises at least 85 wt-%, more preferably at least 90 wt-%, and even more preferably at least 93 wt-% isoalkanes of the total weight of the isoalkane solvent. Isoalkane solvents comprising at least 85 wt-%, more preferably at least 90 wt-%, and even more preferably at least 93 wt-% isoalkanes of the total weight of the isoalkane solvent may also be referred to as aliphatic highly isoparaffinic solvents. A high wt-% amount of isoalkanes in the isoalkane solvent further improves the rust removal properties, the release properties, and the penetrating performance of the penetrating oil. Also, the cold properties, and the stability of the penetrating oil are further improved as the wt-% isoalkanes in the isoalkane solvent increases. In certain embodiments, the isoalkane solvent comprises at most 98 wt-% isoalkanes of the total weight of the isoalkane solvent.

In certain embodiment, of the isoalkanes in the isoalkane solvent at least 70 wt-%, preferably at least 80 wt-%, more preferably at least 85 wt-%, even more preferably at least 90 wt-% are in the range of carbon number C14-C20. An advantage of a high wt-% of the isoalkanes being in the range of carbon number C14-C20 is that the penetrating oil remains effective longer after its application, i.e. it retains its penetrating performance, release properties, and lubricating properties longer compared to penetrating oils formulated with more volatile solvents. Isoalkanes in the range of carbon number C14-C20 have a beneficial evaporation profile, i.e. they evaporate significantly slower than solvents conventionally comprised in penetrating oils (lighter solvents). Surprisingly, a high wt-% of isoalkanes in the range of carbon number C14-C20 did not negatively affect the penetrating properties of the penetrating oil. In certain embodiments, of the isoalkanes in the isoalkane solvent at most 95 wt-% are in the range of carbon number C14-C20.

In certain embodiment, of the isoalkanes in the isoalkane solvent at least 70 wt-%, preferably at least 80 wt-%, more preferably at least 85 wt-%, even more preferably at least 90 wt-% are in the range of carbon number C14-C18, preferably C16-C18. A high wt-% of isoalkanes in the range of carbon number C14-C18, particularly C16-C18, provides the penetrating oil with prolonged penetrating performance, release properties, and lubricating properties compared to penetrating oils formulated with more volatile solvents without compromising the penetrating performance of the penetrating oil, while contributing to a beneficial kinematic viscosity of the penetrating oil. Of the isoalkanes in the isoalkane solvent at most 95 wt-% may be in the range of carbon number C14-C18 or C16-C18.

In certain preferred embodiments, the isoalkane solvent (aliphatic highly isoparaffinic solvent) comprises at least 90 wt-% isoalkanes of the total weight of the isoalkane solvent and of the isoalkanes in the isoalkane solvent at least 70 wt-%, preferably at least 80 wt-%, more preferably at least 85 wt-%, even more preferably at least 90 wt-% are in the range of carbon number C14-C18. In certain particularly preferred embodiments, the isoalkane solvent (aliphatic highly isoparaffinic solvent) comprises at least 93 wt-% isoalkanes of the total weight of the isoalkane solvent and of the isoalkanes in the isoalkane solvent at least 70 wt-%, preferably at least 80 wt-%, more preferably at least 85 wt-%, even more preferably at least 90 wt-% are in the range of carbon number C14-C18.

In certain especially preferred embodiments, the isoalkane solvent has a kinematic viscosity below 10 $mm^2/s$ at 20° C. as measured according to ENISO3104/1996, and the isoalkane solvent comprises at least 90 wt-% isoalkanes of the total weight of the isoalkane solvent and of the isoalkanes in the isoalkane solvent at least 85 wt-% are in the range of carbon number C14-C18. In certain further especially preferred embodiments, the isoalkane solvent has a kinematic viscosity below 8.0 $mm^2/s$ at 20° C. as measured according to ENISO3104/1996, and the isoalkane solvent comprises at least 93 wt-% isoalkanes of the total weight of the isoalkane solvent and of the isoalkanes in the isoalkane solvent at least 90 wt-% are in the range of carbon number C14-C18. Such isoalkane solvents are especially preferred because they provide the penetrating oil with particularly good penetrating performance, release properties, evaporation profile, cold properties, and a beneficial viscosity profile. In other words, the isoalkane solvents according to the especially preferred embodiments were found to be particularly beneficial as components in penetrating oil.

Both the carbon number distribution and the wt-% of isoalkanes in the isoalkane solvent may influence the kinematic viscosity of the isoalkane solvent. Generally, the kinematic viscosity decreases as the length of the carbon chains of the isoalkanes decreases. Increasing the wt-% of isoalkanes in the isoalkane solvent typically decreases the kinematic viscosity of the isoalkane solvent, especially at low temperatures, such as at −10° C. or colder, for example −20° C. or colder, or −30° C. or colder, providing the penetrating oil with a beneficial viscosity profile. Also the pour point and the flash point of the isoalkane solvent have been found to be influenced by the carbon number distribution and the wt-% of isoalkanes in the isoalkane solvent.

Increasing the wt-% of isoalkanes in the isoalkane solvent generally decreases its pour point. In certain embodiments, the isoalkane solvent comprises at least 90 wt-% isoalkanes of the total weight of the isoalkane solvent and of the isoalkanes in the isoalkane solvent at least 85 wt-% are in the range of carbon number C14-C18, the pour point of the isoalkane solvent being less than −40° C. as measured according to ASTM D 5950-2014. Further, in certain embodiments, the isoalkane solvent comprises at least 93 wt-% isoalkanes of the total weight of the isoalkane solvent and of the isoalkanes in the isoalkane solvent at least 90 wt-% are in the range of carbon number C14-C18, the pour point of the isoalkane solvent being less than -50° C. as measured according to ASTM D 5950-2014. A low pour point of the isoalkane solvent provides the penetrating oil with good cold properties allowing it to be used as a penetrating oil at low ambient temperatures, such as at −10° C. or colder temperatures, for example at −20° C. or colder temperatures, or at −30° C. or colder temperatures.

In certain embodiments, the isoalkane solvent comprises at least 90 wt-% isoalkanes of the total weight of the isoalkane solvent and of the isoalkanes in the isoalkane solvent at least 85 wt-% are in the range of carbon number C14-C18, the flash point of the isoalkane solvent being at least 65° C. as measured according to ASTM D 93-2010a (2011). Further, in certain embodiments, the isoalkane solvent comprises at least 93 wt-% isoalkanes of the total weight of the isoalkane solvent and of the isoalkanes in the isoalkane solvent at least 90 wt-% are in the range of carbon number C14-C18, the flash point of the isoalkane solvent being at least 70° C. as measured according to ASTM D 93-2010a (2011). An isoalkane solvent with a high flash point improves the safety of the penetrating oil, both during use and storage of the penetrating oil.

The isoalkane solvent comprises to a large extent non-cyclic alkanes, particularly isoalkanes. In certain embodiments, the isoalkane solvent comprises normal alkanes at most 15 wt-%, preferably at most 10 wt-%, further preferably at most 8 wt-%, even more preferably at most 7 wt-% of the total weight of the isoalkane solvent. In certain embodiments, the isoalkane solvent comprises normal alkanes at least 2 wt-%, such as at least 4 wt-%, of the total weight of the isoalkane solvent. The isoalkane solvent has preferably a low content of cycloalkanes and a low content of alkenes. In certain embodiments, the isoalkane solvent comprises at most 5.0 wt-%, preferably at most 2.0 wt-% cycloalkanes and less than 2.0 wt-%, preferably at most 1.0 wt-%, more preferably at most 0.5 wt-% alkenes of the total weight of isoalkane solvent.

Preferably, the isoalkane solvent has a low content, or is free from, aromatic compounds (aromatics) and/or volatile organic compounds (VOCs). Accordingly, in certain embodiments, the isoalkane solvent comprises at most 1.0 wt-%, preferably at most 0.5 wt-%, more preferably at most 0.2 wt-% aromatics of the total weight of the isoalkane solvent and/or less than 5 wt-% VOCs of the total weight of the isoalkane solvent. A low wt-% amount of aromatics and/or VOCs improves user and environmental safety, particularly in customer applications where use of protective equipment or clothing may sometimes be overlooked.

The renewable isoalkane solvent may be an isoalkane solvent derived from renewable sources, non-renewable sources, or both. However, the isoalkane solvent is preferably an isoalkane solvent derived from renewable sources to increase the environmental sustainability of the penetrating oil. Preferably, the renewable sources from which the renewable isoalkane solvent is derived are renewable oils, renewable fats, or a combination thereof. The renewable isoalkane solvent may for example be obtained via hydrotreatment of a renewable feedstock comprising fatty acids, fatty acid derivatives, mono-, di- or triglycerides, or a combination thereof, followed by an isomerisation treatment. The renewable feedstock may comprise or be derived from vegetable oil, wood oil, other plant based oil, animal oil, animal fat, fish fat, fish oil, algae oil, microbial oil, or a combination thereof. Optionally, the renewable feedstock may comprise recyclable waste and/or recyclable residue, such as used cooking oil, free fatty acids, palm oil by-products or process side streams, sludge, side streams from vegetable oil processing, or a combination thereof.

The hydrotreatment may be hydrodeoxygenation (HDO), preferably catalytic hydrodeoxygenation (catalytic HDO). The hydrotreatment is preferably performed at a pressure selected from the range 2-15 MPa, preferably 3-10 MPa, and at a temperature selected from the range 200-500° C., preferably 280-400° C. The hydrotreatment may be performed in the presence of known hydrotreatment catalyst containing metals from Group VIII and/or VIB of the Periodic System. Preferably, the hydrotreatment catalysts are supported Pd, Pt, Ni, NiW, NiMo or a CoMo catalyst, wherein the support is alumina and/or silica. Typically, $NiMo/Al_2O_3$ and/or $CoMo/Al_2O_3$ catalysts are used. The isomerisation treatment following the hydrotreatent is not particularly limited. Nevertheless, catalytic isomerisation treatments are preferred. The isomerisation treatment is preferably performed at a temperature selected from the range 200-500° C., preferably 280-400° C., and at a pressure selected from the range 2-15 MPa, preferably 3-10 MPa. The isomerisation treatment may be performed in the presence of known isomerisation catalysts, for example, catalysts containing a molecular sieve and/or a metal selected from Group VIII of the Periodic Table and a carrier. Preferably, the isomerisation catalyst is a catalyst containing SAPO-11 or SAPO-41 or ZSM-22 or ZSM-23 or ferrierite and Pt, Pd, or Ni and $Al_2O_3$ or $SiO_2$. Typical isomerisation catalysts are, for example, $Pt/SAPO\text{-}11/Al_2O_3$, $Pt/ZSM\text{-}22/Al_2O_3$, $Pt/ZSM\text{-}23/Al_2O_3$ and/or $Pt/SAPO\text{-}11/SiO_2$. Catalyst deactivation may be reduced by the presence of molecular hydrogen in the isomerisation treatment.

The oil derived from biological sources may be a plant oil or a derivative thereof, preferably a vegetable oil or a derivative thereof. In certain preferred embodiments, the oil derived from biological sources is an ester oil derived from biological sources, preferably a triglyceride oil. Preferably, the ester oil comprises at least 95 wt-%, more preferably at least 98 wt-% esters of the total weight of the ester oil. Similarly, the triglyceride oil comprises preferably at least 95 wt-%, more preferably at least 98 wt-% triglycerides of the total weight of the triglyceride oil. It was surprisingly found that penetrating oils comprising isoalkane solvent and oil derived from biological sources, particularly ester oil or triglyceride oil, have lower viscosity (kinematic viscosity) particularly at low ambient temperatures, such as at −10° C. or colder temperatures, and lower surface tension compared to penetrating oils formulated with conventional, paraffinic mineral oils. In other words, penetrating oils comprising isoalkane solvent and oil derived from biological sources, particularly ester oil or triglyceride oil, were found to have better penetrating performance than penetrating oils formulated with conventional, paraffinic mineral oils. Further, ester oil derived from biological sources, particularly triglyceride oil, is safe, biodegradable and renewable contributing to the safety and environmental sustainability of the penetrating oil.

The oil derived from biological sources may be genetically or chemically modified. In certain embodiments, the oil derived from biological sources comprises additives, such as refrigerant. In certain embodiments, the oil derived from biological sources is an ester oil additised with a refrigerant. In certain embodiments, the oil derived from biological sources is or comprises a chemically modified triglyceride oil. Particularly, the triglyceride oil may have been subjected to a hydrogenation treatment to reduce the amount of di- and/or multiunsaturated fatty acid chains.

In certain embodiments, the oil derived from biological sources is rapeseed oil or optionally a derivative thereof. Rapeseed oil and derivatives thereof were surprisingly found to provide the penetrating oil with particularly good penetration performance and release and lubrication properties. Further, rapeseed oil and derivatives thereof are safe, biodegradable and renewable contributing to the safety and environmental sustainability of the penetrating oil.

In certain embodiments, the oil derived from biological sources has a higher kinematic viscosity than the isoalkane solvent. The kinematic viscosity of the oil derived from biological sources may be more than 8 $mm^2/s$, preferably more than 10 $mm^2/s$, more preferably more than 12 $mm^2/s$ as measured at 20° C. according to ENISO3104/1996. In certain embodiments the kinematic viscosity of the oil derived from biological sources may be more than 6 $mm^2/s$, preferably more than 7 $mm^2/s$, more preferably more than 8 $mm^2/s$ as measured at 40° C. according to ENISO3104/1996. A desirable viscosity profile and good lubricating and release properties of the penetrating oil may be obtained by adjusting the vol-% of isoalkane solvent and the vol-% of oil derived from biological sources in the penetrating oil. Without wishing to be bound by any theory it is believed that the improved penetrating performance of the penetrating oil is at least partly contributed by the isoalkane solvent having lower kinematic viscosity than the oil derived from biological sources acting as a carrier for the higher viscosity component.

The lubricity additive comprises solid particles and carrier oil. The carrier oil of the lubricity additive may be a fossil oil or mineral oil (oil derived from fossil sources), or an oil derived from biological sources. In certain embodiments, the carrier oil is so called white oil, i.e. a fossil or mineral paraffin oil (CAS 8042-47-5). Said white oil is a liquid at 20° C. (and at a pressure around 1 atm (around 101,325 kPa)).

Preferably, the carrier oil has a viscosity (kinematic viscosity) as measured according to ENISO3104/1996 at 20° C. within the range from 10 $mm^2/s$ to 18.5 $mm^2/s$. This viscosity range is preferred because it promotes the stability of the lubricity additive without interfering with the penetrating and release properties of the penetrating oil.

Preferably, the solid particles of the lubricity additive have a particle size below 50 μm, preferably below 20 μm, more preferably below 10 μm, even more preferably below 1 μm. Solid particles with a particle size below said values were found to penetrate particularly well between surfaces in close contact with each other. In certain embodiments, the solid particles of the lubricity additive have a particle size above 10 nm, preferably above 30 nm, more preferably above 50 nm, even more preferably above 70 nm. Solid particles with a particle size above said values were found to provide the penetrating oil with good lubricity properties and particularly good separation properties, especially under high load or pressure.

Preferably, the solid particles of the lubricity additive are dry lubricants. The solid particles of the lubricity additive may be selected for example from boron nitride particles, graphite particles, molybdenum sulfide particles, or polytetrafluoroethylene particles, or optionally a combination thereof.

An advantage of graphite particles is that they are biodegradable. Optionally, a fully biodegradable penetrating oil composition may be provided by embodiments in which the solid particles of the lubricity additive are graphite particles and the carrier oil is a biodegradable carrier oil, such as an oil derived from biological sources.

Preferably, the solid particles of the lubricity additive are boron nitride particles, more preferably particles of crystalline hexagonal boron nitride. Boron nitride particles were found to provide the penetrating oil with particularly good separation and lubricity properties. In certain preferred embodiments, the solid particles are boron nitride particles, preferably particles of crystalline hexagonal boron nitride, having a particle size below 10 μm, preferably below 1 um, and preferably above 30 nm, more preferably above 50 nm.

In certain particularly preferred embodiments, the lubricity additive comprises, based on the total weight of the lubricity additive, 10-30 wt-% boron nitride particles, preferably particles of crystalline hexagonal boron nitride, said particles preferably having a particle size below 10 um, more preferably below 1 um, and preferably above 30 nm, more preferably above 50 nm, and 70-90 wt-% mineral paraffin oil as carrier oil. Lubricity additives according to said embodiments were found to be particularly stable (prolonged time before solid particles settle out of the mixture of solid particles and the carrier oil), and to provide the penetrating oil with particularly beneficial lubricating, release, and separation properties.

In certain particularly preferred embodiments, the penetrating oil comprises, based on the total volume of the penetrating oil, 85-92.1 vol-% isoalkane solvent comprising at least 90 wt-% isoalkanes of the total weight of the isoalkane solvent, and of the isoalkanes in the isoalkane solvent at least 90 wt-% are in range of carbon number C14-C18, 5-10 vol-% triglyceride oil, preferably rapeseed oil or optionally a derivative thereof, 0.9-2 vol-% lubricity additive comprising 10-30 wt-% crystalline hexagonal boron nitride particles having a particle size below 10 um, preferably below 1 um and above 10 nm, preferably above 50 nm, and 70-90 wt-% mineral paraffin oil as carrier oil of the total weight of the lubricity additive, and 2-7 vol-% $CO_2$ as propellant.

Penetrating oils according to these particularly preferred embodiments were found to have outstanding penetrating performance, release properties, lubricating properties, stability, and cold properties. Such penetrating oils were found to have a viscosity (kinematic viscosity) of 3-5 $mm^2/s$ at 40° C. as measured according to ENISO3104/1996 and 20-25 $mm^2$ at -20° C. as measured according to ENISO3104/1996, said penetrating oils thus being particularly suitable for use as penetrating oils over a large temperature range including low ambient temperatures.

The present invention also provides a method for producing a penetrating oil, the method comprising the step of mixing an isoalkane solvent with an oil derived from biological sources (mixing step of penetrating oil components) to form a penetrating oil comprising 55-98 vol-% isoalkane solvent and 2-30 vol-% oil derived from biological sources.

In certain embodiments, the method comprises mixing the isoalkane solvent with the oil derived from biological sources (mixing step of penetrating oil components) to form a penetrating oil comprising 70-98 vol-% isoalkane solvent and 2-30 vol-% oil derived from biological sources, preferably 80-98 vol-% isoalkane solvent and 2-20 vol-% oil derived from biological sources of the total volume of the penetrating oil. In certain embodiments, the total amount of the isoalkane solvent and the oil derived from biological sources in the formed penetrating oil is at least 95 vol-%, preferably at least 98 vol-%, further preferably at least 99 vol-% of the total volume of the penetrating oil.

In certain embodiments, the method comprises, prior to the mixing step of penetrating oil components, selecting an isoalkane solvent having a kinematic viscosity below 12 $mm^2/s$, preferably below 10 $mm^2/s$, more preferably below 8.0 $mm^2/s$, and/or at least 1.0 $mm^2/s$, preferably at least 2.0 $mm^2/s$, more preferably at least 3.0 $mm^2/s$ at 20° C. as measured according to ENISO3104/1996 at 20° C.; and optionally, prior to the mixing step of penetrating oil components, selecting an oil derived from biological sources having a higher kinematic viscosity at 20° C. as measured according to ENISO3104/1996 than the selected isoalkane solvent. When the targeted kinematic viscosity of the penetrating oil is higher than the kinematic viscosity of the isoalkane solvent, for reaching said target it is typically required to select an oil derived from biological sources having a higher kinematic viscosity than the target kinematic viscosity of the penetration oil.

In certain embodiments, the method comprises mixing solid particles with a carrier oil to form a lubricity additive comprising 5-50 wt-% solid particles and 50-95 wt-% carrier oil, preferably 10-40 wt-% solid particles and 60-90 wt-% carrier oil, more preferably 10-30 wt-% solid particles and 70-90 wt-% carrier oil, and even more preferably 20-30 wt-% solid particles and 70-80 wt-% carrier oil of the total weight of the lubricity additive. Preferably, the total amount of the solid particles and the carrier oil in the formed lubricity additive is at least 98 wt-%, more preferably at least 99 wt-% of the total weight of the lubricity additive.

In certain preferred embodiments, the mixing of solid particles with the carrier oil is performed by high speed mixing at 1000-10000 rpm. High speed mixing at 1000-10000 rpm was found to promote dispersion of the solid particles into the carrier oil and to improve the stability of the dispersed particles in the carrier oil (prolong the time it takes before particles start to sediment in the lubricity additive). Preferably, the duration of the high speed mixing is 0.5-4 h, and the high speed mixing is preferably performed at a temperature within the range from 15 to 35° C. Such high speed mixing further promotes dispersion of the solid particles into the carrier oil and improves the stability of the dispersed particles in the carrier oil. However, any suitable method for dispersing the solid particles in the carrier oil can be employed.

In certain embodiments, the method comprises dispersing solid particles into a carrier oil to form a lubricity additive comprising 5-50 wt-% solid particles and 50-95 wt-% carrier oil, preferably 10-40 wt-% solid particles and 60-90 wt-% carrier oil, more preferably 10-30 wt-% solid particles and 70-90 wt-% carrier oil, and even more preferably 20-30 wt-% solid particles and 70-80 wt-% carrier oil of the total weight of the lubricity additive. Preferably, the dispersing of solid particles into the carrier oil is performed by high speed mixing at 1000-10000 rpm for a duration of 0.5-4 h at a temperature selected from the range from 15 to 35° C. Such high speed mixing promotes the dispersion of the solid particles into the carrier oil and improves the stability of the formed lubricity additive.

In certain particularly preferred embodiments, the method comprises mixing by high speed mixing at 1000-10000 rpm for a duration of 0.5-4 h at a temperature within the range from 15 to 35° C. boron nitride particles, preferably particles of crystalline hexagonal boron nitride, having a particle size preferably below 10 um, more preferably below 1 um, and preferably above 30 nm, more preferably above 50 nm, with a mineral paraffin oil to form a lubricity additive comprising 10-30 wt-% boron nitride particles and 70-90 wt-% mineral paraffin oil of the total weight of the lubricity additive.

After the step of mixing or dispersing solid particles into the carrier oil, the lubricity additive may be mixed with the isoalkane solvent and the oil derived from biological sources (mixing step of penetrating oil components) to form a penetrating oil comprising 55-97.9 vol-% isoalkane solvent, 0.1-5 vol-% lubricity additive, and 2-30 vol-% oil derived from biological sources of the total volume of the penetrating oil. Preferably, the lubricity additive is mixed with the isoalkane solvent and the oil derived from biological sources (mixing step of penetrating oil components) to form a penetrating oil comprising 70-97.5 vol-% isoalkane solvent, 2-20 vol-% oil derived from biological sources, and 0.5-2 vol-% lubricity additive of the total volume of the penetrating oil. More preferably, the lubricity additive is mixed with the isoalkane solvent and the oil derived from biological sources (mixing step of penetrating oil components) to form a penetrating oil comprising 80-94.1 vol-%, preferably 85-92 vol-%, isoalkane solvent, 5-10 vol-% oil derived from biological sources, and 0.9-2 vol-% lubricity additive of the total volume of the penetrating oil. Preferably, the total amount of the isoalkane solvent, the oil derived from biological sources, and the lubricity additive in the formed penetrating oil is at least 95 vol-%, preferably at least 98 vol-%, further preferably at least 99 vol-% of the total volume of the penetrating oil.

In certain embodiments, the method comprises mixing the isoalkane solvent, the oil derived from biological sources, and optionally the lubricity additive, with a propellant (mixing step of penetrating oil components) to form a penetrating oil comprising 55-97 vol-% isoalkane solvent, 2-30 vol-% oil derived from biological sources, 1-10 vol-% propellant, and optionally 0.1-5 vol-% lubricity additive, of the total volume of the penetrating oil. Preferably, the total amount of the isoalkane solvent, the oil derived from biological sources, the propellant, and optionally the lubricity additive in the formed penetrating oil is at least 98 vol-%, further preferably at least 99 vol-% of the total volume of the penetrating oil.

In certain embodiments, the method comprises mixing the isoalkane solvent, and the oil derived from biological sources, with a propellant (mixing step of penetrating oil components) to form a penetrating oil comprising 55-97 vol-% isoalkane solvent and 2-30 vol-% oil derived from biological sources, preferably 70-97 vol-% isoalkane solvent and 2-29 vol-% oil derived from biological sources, more preferably 80-97 vol-% isoalkane solvent and 2-19 vol-% oil derived from biological sources, and 1-10 vol-% propellant, preferably 2-7 vol-% $CO_2$, of the total volume of the penetrating oil.

In certain embodiments, the method comprises dissolving the isoalkane solvent, and the oil derived from biological sources with a propellant to form a penetrating oil comprising 55-97 vol-% isoalkane solvent and 2-30 vol-% oil derived from biological sources, preferably 70-97 vol-% isoalkane solvent and 2-29 vol-% oil derived from biological sources, more preferably 80-97 vol-% isoalkane solvent and 2-19 vol-% oil derived from biological sources, and 1-10 vol-% propellant, preferably 2-7 vol-% $CO_2$, of the total volume of the penetrating oil. In certain embodiments, the total amount of the isoalkane solvent, the oil derived from biological sources, and the propellant in the formed penetrating oil is at least 98 vol-%, preferably at least 99 vol-% of the total volume of the penetrating oil.

In certain preferred embodiments, the method comprises mixing the isoalkane solvent, the oil derived from biological sources, and the lubricity additive with a propellant (mixing step of penetrating oil components) to form a penetrating oil comprising 55-96.9 vol-% isoalkane solvent, 2-30 vol-% oil derived from biological sources, 0.1-5 vol-% lubricity additive, and 1-10 vol-% propellant, preferably 2-7 vol-% $CO_2$ of the total volume of the penetrating oil. Preferably, the method comprises mixing the isoalkane solvent, the oil derived from biological sources, and the lubricity additive with a propellant (mixing step of penetrating oil components) to form a penetrating oil comprising 70-96.5 vol-% isoalkane solvent, 2-20 vol-% oil derived from biological sources, 0.5-2 vol-% lubricity additive, and 1-10 vol-% propellant, preferably 2-7 vol-% $CO_2$ of the total volume of the penetrating oil. More preferably, the method comprises mixing the isoalkane solvent, the oil derived from biological sources, and the lubricity additive with a propellant (mixing step of penetrating oil components) to form a penetrating oil comprising 80-93.1 vol-%, preferably 85-92.1 vol-%, isoalkane solvent, 5-10 vol-% oil derived from biological sources, 0.9-2 vol-% lubricity additive comprising 10-30 wt-% solid particles and 70-90 wt-% carrier oil of the total weight of the lubricity additive, and 1-10 vol-% propellant, preferably 2-7 vol-% $CO_2$, of the total volume of the penetrating oil. Preferably, the total amount of the isoalkane solvent, the oil derived from biological sources, the lubricity additive, and the propellant in the formed penetrating oil is at least 98 vol-%, preferably at least 99 vol-% of the total volume of the penetrating oil.

In the embodiments wherein the formed penetrating oil comprises the preferred 2-7 vol-% $CO_2$ as propellant, the upper limit of the vol-% range of the isoalkane solvent in the formed penetrating oil is adjusted accordingly so that the sum of the vol-% of the isoalkane solvent, $CO_2$, the oil derived from biological sources, and the optional lubricity additive in the formed penetrating oil does not exceed 100 vol-%, as explained previously more in detail.

The present invention further provides use of the penetrating oil of the first aspect as a penetrating oil, release oil and/or rust remover. In other words, the present invention further provides use of a composition comprising 55-98 vol-% isoalkane solvent and 2-30 vol-% oil derived from biological sources, preferably 70-98 vol-% isoalkane solvent and 2-30 vol-% oil derived from biological sources, more preferably 80-98 vol-% isoalkane solvent and 2-20 vol-% oil derived from biological sources of the total volume of the composition as a penetrating oil, release oil and/or a rust remover. It has surprisingly been found that compositions comprising a high vol-% amount isoalkane solvent and of an oil derived from biological sources has very good penetrating performance, release properties, and rust removal properties. In other words, such compositions perform very well when used as a penetrating oil, a release oil and/or a rust remover. The penetrating performance and rust removal properties are further improved as the vol-% of the isoalkane solvent in the composition increases. In certain embodiments, the total amount of the isoalkane solvent and the oil derived from biological sources in the composition is at least 95 vol-%, preferably at least 98 vol-%, further preferably at least 99 vol-% of the total volume of the composition.

In certain embodiments, the composition comprises, based on the total volume of the composition, 55-97.9 vol-% isoalkane solvent, 2-30 vol-% oil derived from biological sources, and 0.1-5 vol-% lubricity additive comprising 5-50 wt-% solid particles and 50-95 wt-% carrier oil of the total weight of the lubricity additive. It was found that the lubricity additive comprising solid particles improves the separation and release properties and the lubricating properties of the composition. Further, the lubricity additive improves the performance (release properties, separation properties, lubricating properties) of the composition at high pressure conditions (under high load) when the composition is used as a penetrating oil and/or a release oil. In certain preferred embodiments, the composition comprises, based on the total volume of the composition, 70-97.5 vol-% isoalkane solvent, 2-20 vol-% oil derived from biological sources, and 0.5-2 vol-% lubricity additive comprising 10-40 wt-% solid particles and 60-90 wt-% carrier oil of the total weight of the lubricity additive. In certain particularly preferred embodiments, the penetrating oil comprises, based on the total volume of the penetrating oil, 80-94.1 vol-%, preferably 85-92 vol-%, isoalkane solvent, 5-10 vol-% oil derived from biological sources, and 0.9-2 vol-% lubricity additive comprising 10-30 wt-% solid particles and 70-90 wt-% carrier oil of the total weight of the lubricity additive. The total amount of the isoalkane solvent, the oil derived from biological sources, and the lubricity additive in the penetrating oil may be at least 95 vol-%, preferably at least 98 vol-%, further preferably at least 99 vol-% of the total volume of the composition.

To facilitate the use of the composition as a penetrating oil, release oil and/or a rust remover, particularly in customer applications, the composition may be provided as an aerosol. In certain embodiments, the composition comprises, based on the total volume of the composition, 55-97 vol-% isoalkane solvent and 2-30 vol-% oil derived from biological sources, preferably 70-97 vol-% isoalkane solvent and 2-29 vol-% oil derived from biological sources, more preferably 80-97 vol-% isoalkane solvent and 2-19 vol-% oil derived from biological sources, and 1-10 vol-% propellant, preferably 2-7 vol-% $CO_2$ of the total volume of the compositions. In certain embodiments, the total amount of the isoalkane solvent, the oil derived from biological sources, and the propellant in the composition is at least 98 vol-%, preferably at least 99 vol-% of the total volume of the composition.

In certain preferred embodiments, the composition comprises, based on the total volume of the composition, 55-96.9 vol-% isoalkane solvent, 2-30 vol-% oil derived from biological sources, 0.1-5 vol-% lubricity additive comprising 5-50 wt-% solid particles and 50-95 wt-% carrier oil of the total weight of the lubricity additive, and 1-10 vol-% propellant, preferably 2-7 vol-% $CO_2$. Preferably, the composition comprises, based on the total volume of the composition, 70-96.5 vol-% isoalkane solvent, 2-20 vol-% oil derived from biological sources, 0.5-2 vol-% lubricity additive comprising 10-40 wt-% solid particles and 60-90 wt-% carrier oil of the total weight of the lubricity additive, and 1-10 vol-% propellant, preferably 2-7 vol-% $CO_2$. More preferably, the composition comprises, based on the total volume of the composition, 80-93.1 vol-%, preferably 85-92.1 vol-%, isoalkane solvent, 5-10 vol-% oil derived from biological sources, 0.9-2 vol-% lubricity additive comprising 10-30 wt-% solid particles and 70-90 wt-% carrier oil of the total weight of the lubricity additive, and 1-10 vol-% propellant, preferably 2-7 vol-% $CO_2$. Preferably, the total amount of the isoalkane solvent, the oil derived from biological sources, the lubricity additive, and the propellant in the composition is at least 98 vol-%, preferably at least 99 vol-% of the total volume of the composition.

In the embodiments wherein the composition comprises the preferred 2-7 vol-% $CO_2$ as propellant, the upper limit of the vol-% range of the isoalkane solvent in the composition is adjusted accordingly so that the sum of the vol-% of the isoalkane solvent, $CO_2$, the oil derived from biological sources, and the optional lubricity additive in the composition does not exceed 100 vol-%, as explained previously more in detail.

EXAMPLES

Example 1

Rust Removal and Release Properties of Isoalkane Solvent

Three experiments were conducted to study the rust removal and release properties of isoalkane solvent. In the first experiment (Example 1.1) the rust removal properties of an isoalkane solvent were compared with those of a commercial petroleum naphtha based rust remover. In the second experiment (Example 1.2) the rust removal properties of the isoalkane solvent were compared with the rust removal properties of a commercial multipurpose oil based on mineral oil and petroleum distillates. In the third experiment (Example 1.3), the release properties of the isoalkane solvent were compared with the release properties of the commercial multipurpose oil based on mineral oil and petroleum distillates.

The isoalkane solvent employed in all Examples 1.1, 1.2, and 1.3 comprised approximately 94 wt-% isoalkanes and 6 wt-% normal alkanes. The composition of the isoalkane solvent was analysed by gas chromatography (GC) and normal alkanes and isoalkanes were identified using mass spectrometry and suitable reference compounds. The cloud point of the isoalkane solvent as measured according to ASTMD7689-17 was -34° C. The carbon number distributions of the isoalkanes and the normal alkanes in the isoalkane solvent are shown in Table 1. The isoalkane solvent employed in Examples 1.1, 1.2, and 1.3 was a renewable isoalkane solvent comprising 100 wt-% biobased carbon (carbon derived from renewable sources, renewable carbon) of the total weight of carbon in the isoalkane solvent as determined according to DIN 51637 (2014).

TABLE 1

Carbon number distribution of the isoalkanes and the normal alkanes of the isoalkane solvent of Examples 1.1, 1.2, and 1.3.

| Carbon number | Isoalkanes (wt-%) | Normal alkanes (wt-%) | Total (wt-%) |
|---|---|---|---|
| 3 | 0 | 0 | 0 |
| 4 | 0 | 0 | 0 |
| 5 | 0 | 0 | 0 |
| 6 | 0.01 | 0.02 | 0.02 |
| 7 | 0.06 | 0.04 | 0.1 |
| 8 | 0.23 | 0.15 | 0.39 |
| 9 | 0.7 | 0.24 | 0.95 |
| 10 | 1.07 | 0.22 | 1.29 |
| 11 | 1.15 | 0.18 | 1.33 |
| 12 | 1.28 | 0.15 | 1.44 |
| 13 | 1.65 | 0.14 | 1.79 |
| 14 | 3.16 | 0.29 | 3.45 |
| 15 | 10.78 | 0.95 | 11.73 |
| 16 | 20.74 | 1.36 | 22.1 |
| 17 | 23.7 | 0.88 | 24.58 |
| 18 | 28.14 | 0.95 | 29.1 |
| 19 | 0.81 | 0.06 | 0.87 |
| 20 | 0.42 | 0.02 | 0.43 |
| 21 | 0.11 | 0.01 | 0.11 |
| 22 | 0.06 | 0 | 0.07 |
| 23 | 0.02 | 0 | 0.02 |
| 24 | 0.01 | 0 | 0.01 |
| 25-29 | 0.17 | 0 | 0.17 |
| 30-36 | 0.05 | 0 | 0.05 |
| >C36 | 0 | 0 | 0 |
| Total | 94.33 | 5.67 | 100 |

Example 1.1

Rust Removal, Rubbing

A rusted metal tool was rubbed for approximately 5 min with steel wool and either the above described isoalkane solvent or a sprayable commercial petroleum naphtha based rust remover as rubbing aid. The commercially available rust remover employed in this experiment was an aerosol comprising mainly hydrotreated heavy petroleum naphtha, and propane and butane as propellants.

FIG. 1 shows the metal tool after the rust removal treatments by rubbing. The left end of the tool (with the inscription "1") was treated with steel wool and the commercial rust remover, whereas the right end of the tool (with the inscription "300") was treated with steel wool and the isoalkane solvent. Both treatments were found to remove rust. However, the treatment with steel wool and the isoalkane solvent surprisingly removed more rust than the corresponding treatment with the commercial rust remover. Thus, the isoalkane solvent showed very good rust removal properties.

Example 1.2

Rust Removal, Immersion

Figure 2A:
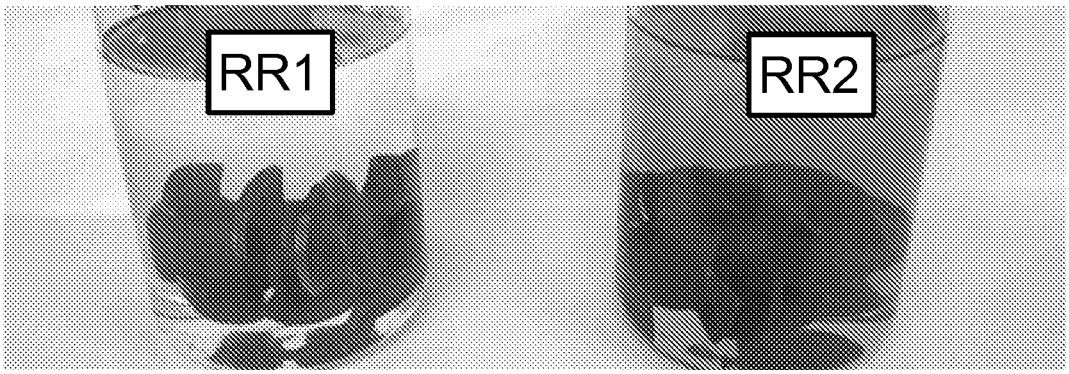
FIG. 2Ashows a picture of metal objects immersed for rust removal in an isoalkane solvent RR1 (at the left) and a commercially available multipurpose oil based on mineral oil and petroleum distillates RR2 (at the right)

Rusted cylindrical metal objects with a number of protrusions as shown in FIG. 2A were immersed for 24 h at 25° C. in 400 ml of the isoalkane solvent described in the foregoing (RR1) and in a commercial multipurpose oil based on mineral oil and petroleum distillates (RR2), respectively. Said commercial multipurpose oil employed in this experiment comprised 50-75 wt-% hydrotreated, light petroleum distillates, such as kerosene, 10-25 wt-% mineral oil, and 1-5 wt-% sulfonic acids, petroleum and/or sodium salts. Said multipurpose oil is recommended for use, for example, as a cleaner for corroded areas, as a lubricant, and as a release oil for freeing components bonded by dirt and scale and for loosening rusted or seized parts. In FIG. 2A, the beaker at the left contains one of the metal objects immersed in the isoalkane solvent (RR1) and the beaker at the right contains one of the metal objects immersed in the commercially available multipurpose oil (RR2). The color difference between the liquids is inherent, i.e. due to the differences in the chemical composition of the liquids.

Figure 2B:
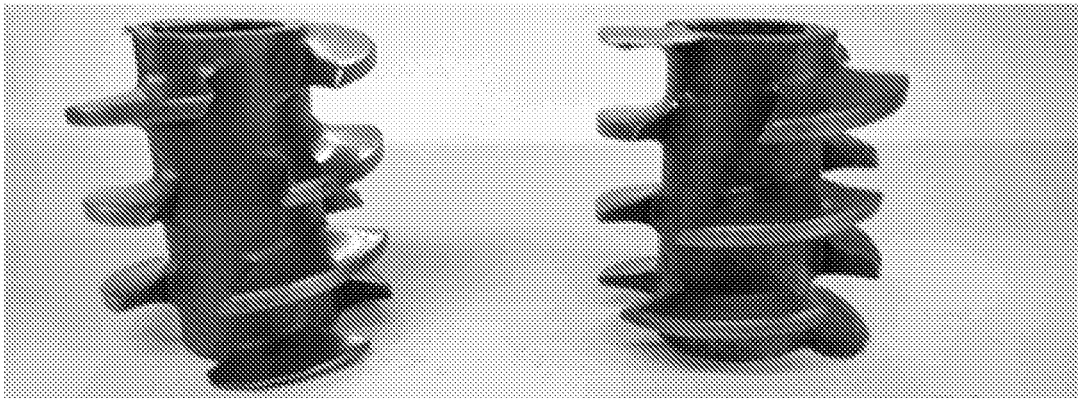
FIG. 2B shows a picture of the metal objects of FIG. 2A after the rust removal by immersion. The metal object at the left was immersed in the isoalkane solvent RR1 and the metal object at the right was immersed in the commercial multipurpose oil RR2.

FIG. 2B shows the metal objects after the rust removal treatment by immersion. In FIG. 2B, the metal object immersed in the isoalkane solvent (RR1) is shown at the left and the metal object immersed in the commercial multipurpose oil (RR2) is shown at the right. Both treatments were found to remove rust from the metal objects. Surprisingly, immersion in the isoalkane solvent removed more rust than the corresponding immersion in the commercial multipurpose oil. In other words, the isoalkane solvent showed very good rust removal properties.

Example 1.3

Release Properties

Figure 3A:
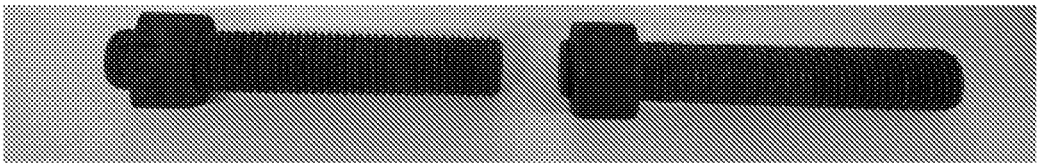
FIG. 3A shows a picture of rusted threaded rods with respective nuts prior to treatment.
Figure 3B:
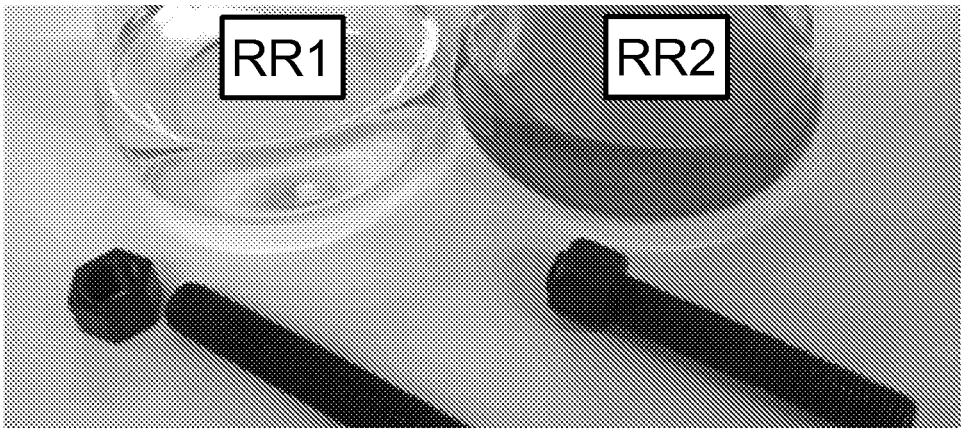
FIG. 3B shows a picture of the treaded rods and nuts of FIG. 3A after immersion in the isoalkane solvent RR1 (at the left) and the commercial multipurpose oil RR2 (at the right), respectively, followed by detachment attempts of the nut from the threaded rod.

Two similar rusted metal objects as shown in FIG. 3A, namely two threaded rods on which a respective nut had been fastened, were immersed for 24 h at 25° C. in 400 ml of the isoalkane solvent described in the foregoing (RR1) and in the above described commercial multipurpose oil based on mineral oil and petroleum distillates (RR2), respectively. After the immersion, detachment of the nut from the threaded rod was performed with a screw bench. The threaded rods and nuts are shown in FIG. 3B after both the immersion and detachment steps. The threaded rod and nut immersed in the isoalkane solvent are shown in FIG. 3B at the left and the threaded rod and nut immersed in the commercial multipurpose oil are shown in FIG. 3B at the right. Surprisingly, the nut could be relative easily detached from the threaded rod after immersion in the isoalkane solvent (RR1), whereas the nut could not be detached from the treaded rod after immersion in the commercially available multipurpose oil (RR2). Although differences between the rusted metal objects employed in this experiment cannot be precisely determined, it can be concluded that the isoalkane solvent has particularly good release properties exceeding the release properties of the commercially available multipurpose oil recommended for used as a release oil.

All in all, based on Examples 1.1-1.3, the isoalkane solvent was found to have very good rust removal and release properties surpassing the rust removal and release properties of commercially available products.

Example 2

Penetrating Properties of Release Oil Formulations

Two experiments were conducted to study the penetrating performance of release oil formulations. In the first experiment (Example 2.1) the penetrating performance of two different release oil formulations was evaluated based on viscosity (kinematic viscosity) and surface tension measurements. In the second experiment (Example 2.2) the penetrating properties of four different compositions were studied by a thread creep test. Further, the water uptake of the four compositions studied in Example 2.2 was analysed (Example 2.3).

Three different release oil compositions F1, F2, and F2 as aerosol were prepared as described in Table 2.

TABLE 2

Composition of formulations F1, F2, and F2 as aerosol.

| | Isoalkane solvent | Mineral oil | Renewable oil | Lubricity additive | $CO_2$ propellant |
|---|---|---|---|---|---|
| F1 | 91 vol-% | 8 vol-% | — | 1 vol-% | — |
| F2 | 91 vol-% | — | 8 vol-% | 1 vol-% | — |
| F2 as aerosol | 86.45 vol-% | — | 7.60 vol-% | 0.95 vol-% | 5.00 vol-% |

Both F1 and F2 comprised, based on the total volume of the respective formulation, 91 vol-% renewable isoalkane solvent comprising approximately 94 wt-% isoalkanes.

Said isoalkane solvent comprised 100 wt-% renewable carbon of the total weight of the carbon in the isoalkane solvent as determined according to DIN 51637 (2014). Further, both F1 and F2 comprised, based on the total volume of the respective formulation, 1 vol-% of a lubricity additive comprising 30 wt-% crystalline hexagonal boron nitride particles and 70 wt-% carrier oil. The carrier oil of the lubricity additive was mineral paraffin oil (white oil).

F1 also contained, based on the total volume of Fl, 8 vol-% highly refined petroleum mineral oil (paraffin oil or white oil, CAS 8042-47-5).

Instead of the mineral oil, F2 contained, based on the total volume of F2, 8 vol-% renewable oil (oil derived from biological sources), namely triglyceride oil having a viscosity (kinematic viscosity) of 8.5 $mm^2/s$ at 40° C. as measured according to 1503104.

F2 as aerosol was prepared by mixing F2 with a $CO_2$ propellant. The final volume percentages, based on the total volume of F2 as aerosol, are shown in Table 2 above.

Example 2.1

Viscosity and Surface Tension

The density, viscosity (kinematic viscosity), interfacial tension, and surface tension were measured for F1 and F2 as described in Table 3 below. The analysis results are also shown in Table 3.

TABLE 3

Measured density, viscosity, interfacial tension, and surface tension of F1 and F2, respectively.

| | | | F1 | F2 |
|---|---|---|---|---|
| ENISO12185 | Density at −20° C. | $kg/m^3$ | 791.2 | 790.2 |
| ENISO3104 | Viscosity at 40° C. | $mm^2/s$ | 3.6 | 3.5 |
| ENISO3104 | Viscosity at 20° C. | $mm^2/s$ | 5.9 | 5.5 |
| ENISO3104 | Viscosity at −10° C. | $mm^2/s$ | 16.5 | 14.9 |
| ENISO3104 | Viscosity −20° C. | $mm^2/s$ | 26.6 | 23.5 |
| ASTMD971M | Interfacial tension | mN/m | 28 | 27 |
| ASTMD971M | Surface tension | mN/m | 27 | 22 |

Generally, it was concluded that the isoalkane solvent could be formulated with both the mineral oil and with the renewable oil. Nevertheless, F2 containing renewable oil had an improved viscosity profile (less pronounced viscosity increase when the temperature was lowered) compared to Fl. As can be seen from Table 3, F2 had a lower viscosity compared to F1 at all temperatures at which the viscosity was measured. The difference in viscosity between F1 and F2 was more pronounced at the lower temperatures, namely at −10° C. and −20° C. The lower viscosity of F2 indicates improved penetrating performance over Fl. Further, as can be seen from Table 3, F2 also had lower interfacial tension and particularly lower surface tension compared to F1, which also indicate improved penetrating performance of F2 compared to F1. Based on the above results it was thus concluded that formulation F2 containing oil derived from biological sources had better penetrating properties than F1 containing mineral oil and that F2 is thus preferred over F1 as a release and/or penetrating oil.

Example 2.2

Thread Creep Test

Four different compositions were compared with each other in the thread creep test; neat isoalkane solvent comprising approximately 94 wt-% isoalkanes, F2 as aerosol as described in the foregoing, the commercial multipurpose oil based on mineral oil and petroleum distillates as described in connection with Example 1.2 (RR2), and said commercial multipurpose oil as an aerosol with $CO_2$ as propellant and additised with MoS2 particles (RR3 as aerosol). The neat isoalkane solvent comprised 100 wt-% renewable carbon of the total weight of the carbon in the isoalkane solvent as determined according to DIN 51637 (2014).

The thread creep test was performed by placing a threaded rod (length 10 cm, diameter 6 mm) into 3 ml of each composition, respectively. The vertical rise along the threaded rod was then measured in mm as a function of time. RED MCNY 25 colorant was added to each of the studied compositions to facilitate the measuring of the rise. The results of the creep test are shown in Table 4.

TABLE 4

Thread creep test results. The results are given in mm vertical rise.

| | 10 min | 30 min | 60 min |
|---|---|---|---|
| Isoalkane solvent | 76 | 81 | 84 |
| F2 as aerosol | 75 | 80 | 84 |
| RR2 | 75 | 79 | 82 |
| RR3 as aerosol | 75 | 80 | 83 |

As can be seen from Table 4 all of the studied compositions had good penetrating properties. Taking into account all timepoints, namely 10 min, 30 min, and 60 min, the isoalkane solvent had the highest rise, followed by F2 as aerosol. At 60 min, both the isoalkane solvent and F2 as aerosol had risen 84 mm, which was higher than either of RR2 or RR3 as aerosol. RR3 as aerosol and RR2 performed slightly worse (lower vertical rise) than the isoalkane solvent and F2 as aerosol. Based on Table 4, it can be concluded that both the isoalkane solvent and F2 as aerosol showed slightly better penetration performance than RR2 and RR3 as aerosol.

Example 2.3

Water Uptake

The water uptake of the compositions studied in Example 2.2 were analysed. 15 ml of each composition and 15 ml water were combined in a test tube, respectively. The test tube was then shaken in a test tube shaker for 1 hour. A sample was taken from the oil phase (phase with the composition being studied) to analysis. The analysis results are shown in Table 5 below.

TABLE 5

Water content analysis results.

| | Water content |
|---|---|
| Isoalkane solvent | 23 ppm by weigth |
| F2 as aerosol | 2600 ppm by weight |
| RR2 | 55.9 wt-% |
| RR3 as aerosol | >50 wt-% * |

* the water content was too high to be quantified.

As can be observed from Table 5, the formulations RR2 and RR3 as aerosol adsorbed significant amounts of water, whereas the isoalkane solvent and F2 as aerosol only adsorbed trace amounts of water. The isoalkane solvent and F2 as aerosol thus perform better as water or moisture barriers providing better protection for, for example, metal parts and objects.

Various embodiments have been presented. It should be appreciated that in this document, words comprise, include and contain are each used as open-ended expressions with no intended exclusivity.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented in the foregoing, but that it can be implemented in other embodiments using equivalent means or in different combinations of embodiments without deviating from the characteristics of the invention.

Furthermore, some of the features of the afore-disclosed embodiments of this invention may be used to advantage without the corresponding use of other features.

As such, the foregoing description shall be considered as merely illustrative of the principles of the present invention, and not in limitation thereof. Hence, the scope of the invention is only restricted by the appended patent claims.

The invention claimed is:

1. A penetrating oil comprising:

55-98 vol % isoalkane solvent of the a total volume of the penetrating oil, wherein the isoalkane solvent contains at least 85 wt % isoalkanes of the total weight of the isoalkane solvent and wherein isoalkanes in the isoalkane solvent contain at least 85 wt % in a range of carbon number C14-C20; and 2-30 vol % oil derived from biological sources of the total volume of the penetrating oil.

2. A penetrating oil comprising:

55-98 vol % isoalkane solvent of the total volume of the penetrating oil;

2-30 vol % oil derived from biological sources of the total volume of the penetrating oil; and a lubricity additive 0.1-5 vol % of the total volume of the penetrating oil, the lubricity additive containing 5-50 wt % solid particles and 50-95 wt % carrier oil of the total weight of the lubricity additive.

3. The penetrating oil according to claim 1, wherein the penetrating oil selected to contain 2-20 vol % oil derived from biological sources of the total volume of the penetrating oil.

4. The penetrating oil according to claim 1, wherein the oil derived from biological sources is an ester oil derived from at least one or more of biological sources.

5. The penetrating oil according to claim 1, containing 70-95 vol % isoalkane solvent of the total volume of the penetrating oil.

6. The penetrating oil according to claim 1, wherein the isoalkane solvent at least 93 wt % isoalkanes of the total weight of the isoalkane solvent.

7. The penetrating oil according to claim 1, wherein the isoalkane solvent comprises:

at most 98 wt % isoalkanes of the total weight of the isoalkane solvent.

8. The penetrating oil according to claim 1, wherein isoalkanes in the isoalkane solvent contain at least 90 wt % in a range of carbon number C14-C20.

9. The penetrating oil according to claim 8, wherein of the isoalkanes in the isoalkane solvent at most 95 wt % are in the range of carbon number C14-C20.

10. The penetrating oil according to claim 1, wherein the isoalkane solvent has a flash point which is above 60° C., as measured according to ASTM D 93-2010a (2011).

11. The penetrating oil according to claim 1, wherein the isoalkane solvent has a pour point that is below −30° C., as measured according to ASTM D 5950-2014.

12. The penetrating oil according to claim 1, wherein the isoalkane solvent has a kinematic viscosity that below 12 $mm^2/s$ at 20° C. as measured according to ENIS03104/1996.

13. The penetrating oil according to claim 1, wherein the isoalkane solvent has a kinematic viscosity that is onc or morc of at least 1.0 m-m-2/s, at (cast 2.0 mm2ʳsandler--at-least-3-0. mm2/sat 20° C. as measured according to ENISO3104/1996.

14. The penetrating oil according to claim 1, wherein the oil derived from biological sources has a higher kinematic viscosity than the isoalkane solvent, the kinematic viscosity of the oil derived from biological sources being at least more than 8 $mm^2/s$ as measured according to ENISO3104/1996.

15. The penetrating oil according to claim 2, comprising:

0.5-2 vol % lubricity additive of the total volume of the penetrating oil;

wherein the lubricity additive contains 10-40 wt % solid particles and 60-90 wt % carrier oil of thea total weight of the lubricity additive; and wherein the solid particles of the lubricity additive are boron nitride particles, graphite particles, molybdenum sulfide particles, or polytetrafluoroethylene particles, or a combination thereof.

16. The penetrating oil according to claim 1, comprising:

a propellant 1-10 vol % of the total volume of the penetrating oil;

wherein the propellant is selected from propane, butane, $CO_2$, $N_2$, or air, or thereof.

17. A method for producing a penetrating oil, the method comprising:

mixing an isoalkane solvent with an oil derived from biological sources to form a penetrating oil containing 55-98 vol % isoalkane solvent and 2-30 vol % oil derived from biological sources of the a total volume of the penetrating oil;

wherein the isoalkane solvent contains at least 85 wt % isoalkanes of the total weight of the isoalkane solvent and wherein isoalkanes in the isoalkane solvent contain at least 85 wt % in a range of carbon number C14-C20.

18. The method according to claim 17, comprising:

mixing solid particles with a carrier oil to form a lubricity additive containing 5-50 wt % solid particles and 50-95 wt % carrier oil of thea total weight of the lubricity additive;

mixing the lubricity additive with the isoalkane solvent and the oil derived from biological sources to form a penetrating oil containing 55-97.9 vol % isoalkane solvent, 0.1-5 vol % lubricity additive, and 2-30 vol % oil derived from biological sources of the total volume of the penetrating oil; and performing the mixing of solid particles with the carrier oil by high speed mixing at 1000-10000 rpm;

wherein thea duration of the high speed mixing is 0.5-4 h, and wherein the high speed mixing is performed at a temperature selected from a range from 15 to 35° C.

19. The method according to claim 17, comprising:

mixing the isoalkane solvent, the oil derived from biological sources, and optionally a lubricity additive, with a propellant to form a penetrating oil containing 55-97 vol % isoalkane solvent, 2-30 vol % oil derived from biological sources, 1-10 vol % propellant, and optionally 0.1-5 vol % lubricity additive, of the total volume of the penetrating oil.

20. The penetrating oil according to claim 1, wherein the penetrating oil has 80-98 vol % isoalkane solvent and 2-20 vol % oil derived from biological sources of the total volume of the penetrating oil.

21. The penetrating oil according to claim 1, wherein the oil derived from biological sources is a triglyceride oil.

* * * * *